US009188394B2

(12) United States Patent
Wang et al.

(10) Patent No.: US 9,188,394 B2
(45) Date of Patent: Nov. 17, 2015

(54) THIN HEAT PIPE HAVING RECESSES FOR FASTENER

(75) Inventors: Cheng-Tu Wang, New Taipei (TW); Chi-Chung Tseng, New Taipei (TW)

(73) Assignee: CHAUN-CHOUNG TECHNOLOGY CORP., New Taipei (TW)

( * ) Notice: Subject to any disclaimer, the term of this patent is extended or adjusted under 35 U.S.C. 154(b) by 1009 days.

(21) Appl. No.: 13/303,484

(22) Filed: Nov. 23, 2011

(65) Prior Publication Data

US 2013/0126125 A1 May 23, 2013

(51) Int. Cl.
*F28F 9/007* (2006.01)
*F28F 9/00* (2006.01)
*F28D 15/02* (2006.01)

(52) U.S. Cl.
CPC ..... *F28D 15/0275* (2013.01); *F28F 9/00* (2013.01)

(58) Field of Classification Search
CPC ..... F28D 15/0275; F28D 15/02; F28F 9/00; F28F 9/007; G06F 1/20; H05K 7/20
USPC ..... 165/67, 80.3, 104.26; 361/720, 700, 361/701, 699
See application file for complete search history.

(56) References Cited

U.S. PATENT DOCUMENTS

| | | | | |
|---|---|---|---|---|
| 8,320,130 | B2 * | 11/2012 | Yang | 361/711 |
| 2004/0070933 | A1 * | 4/2004 | Sarraf et al. | 361/687 |
| 2012/0216991 | A1 * | 8/2012 | Chen | 165/104.21 |
| 2012/0222840 | A1 * | 9/2012 | Huang | 165/104.26 |
| 2013/0000870 | A1 * | 1/2013 | Wu | 165/104.26 |

* cited by examiner

*Primary Examiner* — Travis Ruby
*Assistant Examiner* — Harry Arant
(74) *Attorney, Agent, or Firm* — Chun-Ming Shih; HDLS IPR Services

(57) ABSTRACT

The heat sink includes a fastener and a heat pipe. The fastener has a receiving space, an upper claw and a lower claw. The upper claw and the lower claw are formed in the receiving space. The heat pipe has a first end and a second end. The first end is received in the receiving space and clipped between the upper claw and the second claw, and the upper claw or the lower claw is partially embedded in the heat pipe to be flush with each other.

6 Claims, 7 Drawing Sheets

THIN HEAT PIPE HAVING RECESSES FOR FASTENER

BACKGROUND OF THE INVENTION

1. Technical Field

The invention relates to heat sinks, particularly to heat sinks with heat pipes.

2. Related Art

With the progressiveness of technologies, semiconductor components in electronic devices generate more and more heat. As a result, heat sinks become absolutely necessary.

FIGS. 1 and 2 show a conventional heat sink, which includes a heat pipe 10, a seat 20 and two elastic plates 30. The seat 20 is formed with a trough 201 for receiving the heat pipe 10. The elastic plates 30 are fastened beside the seat 20 by screws 40. Thus, the heat pipe 10 can abut against an electronic device for heat dissipation.

In such a heat sink, however, the heat pipe and the trough 201 must be soldered up to form a tight connection. The soldering will increase a certain height and decrease efficiency of heat dissipation, so it is disadvantageous to lightening and thinning design. Furthermore, the soldering process will also increase manufacturing cost.

SUMMARY OF THE INVENTION

An object of the invention is to provide a thin heat sink, which uses two claws to directly fasten a heat pipe without a soldering process. This reduces manufacturing costs and thickness.

To accomplish the above object, the heat sink of the invention includes a fastener and a heat pipe. The fastener has a receiving space, an upper claw and a lower claw. The upper claw and the lower claw are formed in the receiving space. The heat pipe has a first end and a second end. The first end is received in the receiving space and clipped between the upper claw and the second claw, and the upper claw or the lower claw is partially embedded in the heat pipe.

To accomplish the above object, the heat sink of the invention includes a fastener and a heat pipe. The fastener has a receiving space, an upper claw and a lower claw. The upper claw and the lower claw are formed in the receiving space. The heat pipe has a first end and a second end. The first end is received in the receiving space and clipped between the upper claw and the second claw, and the upper claw or the lower claw is partially embedded in the heat pipe to be flush with each other.

DETAILED DESCRIPTION OF THE INVENTION

Figure 1:
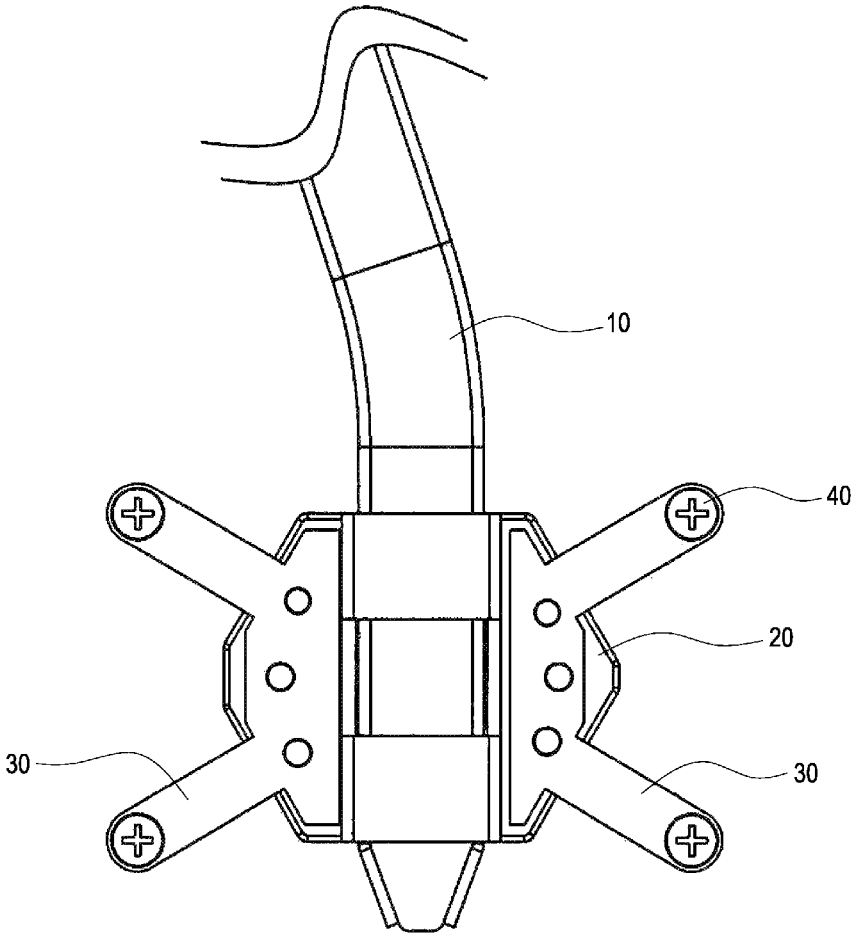
FIG.1 PRIOR ART
FIG. 1 shows a conventional heat sink.
Figure 2:
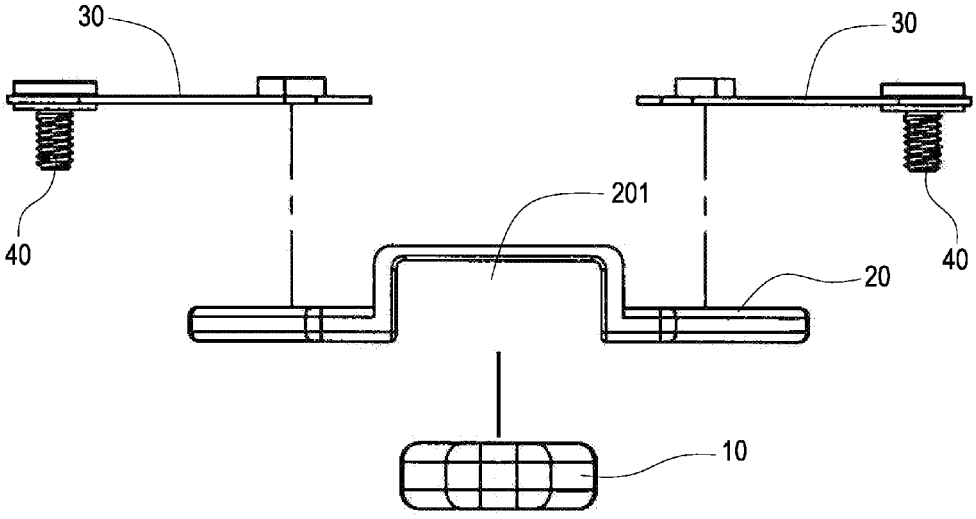
FIG.2 PRIOR ART
FIG. 2 is an exploded view of the heat sink shown in FIG. 1.
Figure 3:
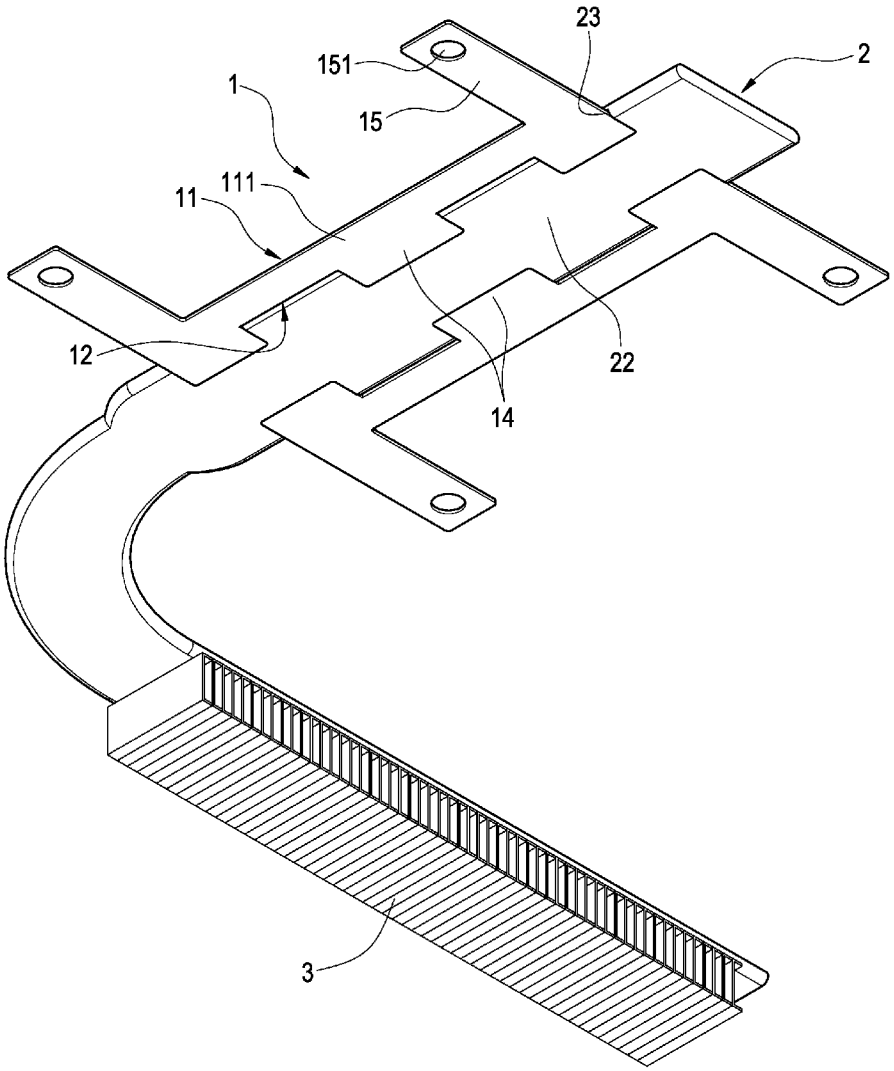
FIG. 3 is a perspective view of the invention.
Figure 4:
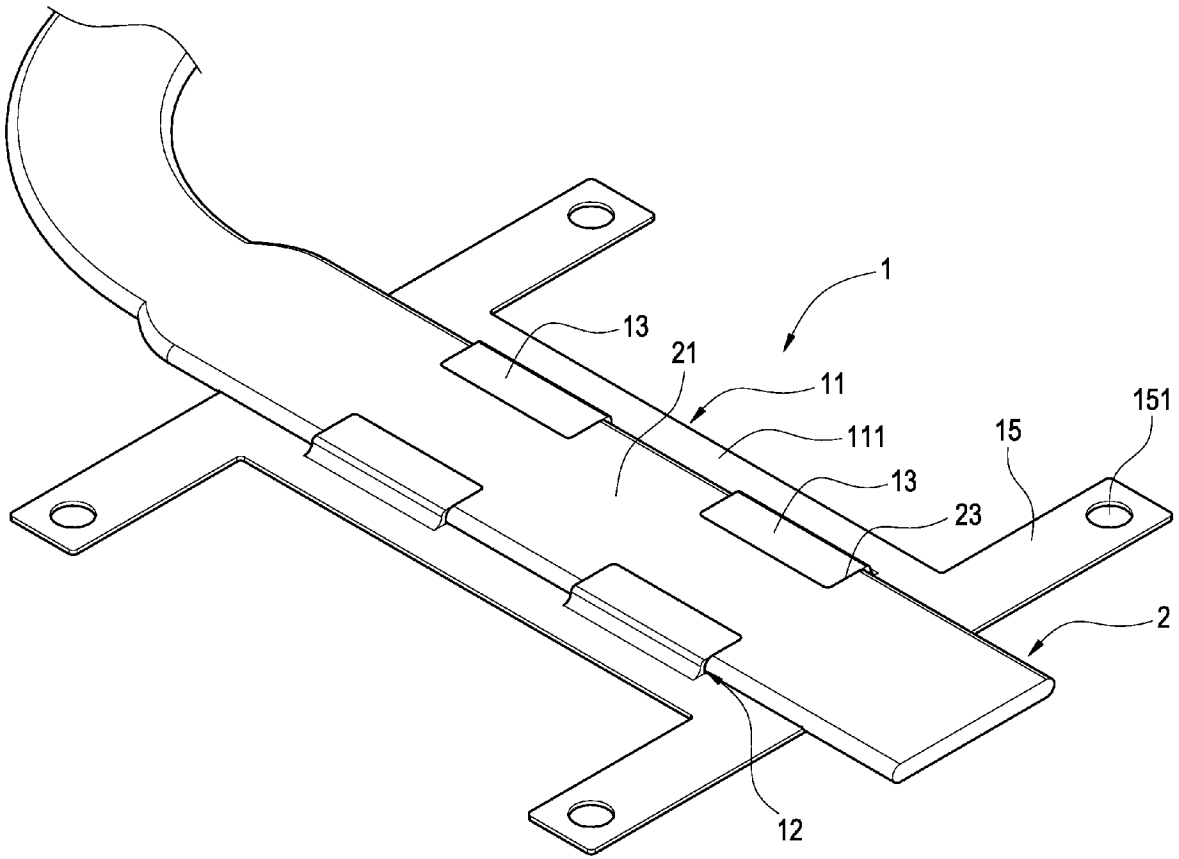
FIG. 4 is a schematic view showing that the first plane is flush with the upper claws.
Figure 5:
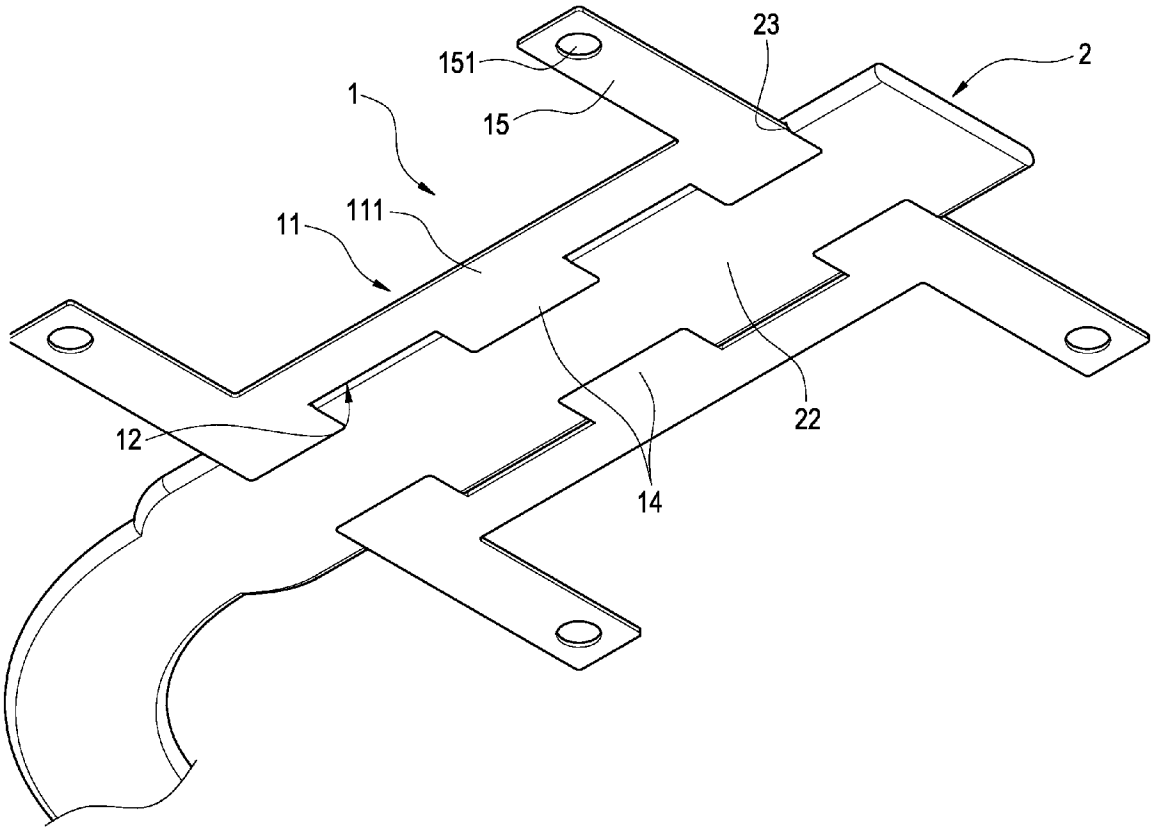
FIG. 5 is a schematic view showing that the second plane is flush with the lower claws.

Please refer to FIGS. 3-5. The heat sink of the invention includes a fastener 1 and a heat pipe 2.

The fastener 1 is formed with two parallel longitudinal sections 111 and a receiving space 12 formed therebetween. One or more upper claws 13 and one or more lower claws separately extend from the longitudinal sections 111 and project into the receiving space 12. The fastener 1 may be composed of two separate elastic plates 11. The two elastic plates 11 are separately formed with the longitudinal sections 111. The upper claws 13 and lower claws 14 are interlaced. The upper claws 13 are bendingly extended from the longitudinal sections 111. The fastener 1 is further formed with one or more outwards fixtures 15. Each fixture 15 has a fixing hole 151.

One end of the heat pipe 2 penetrates the receiving space 12 and is clipped between the upper claws 13 and the lower claws 14. At least one of the upper claws 13 or the lower claws 14 is embedded in the heat pipe 2. The heat pipe 2 may be further flush with the upper claws 13 or the lower claws 14. The heat pipe 2 is deformed by the claws 13, 14 to form recesses 23. The heat pipe 2 has a first plane 21 and a second plane 22. The first plane 21 and the second plane 22 are flush with the upper claws 13 and the lower claws 14, respectively. Besides, the other end of the heat pipe 2 is disposed with fins 3.

The heat pipe 2 is fastened by the claws 13, 14, so a soldering process is not required. Thus the manufacturing process can be simplified and the manufacturing costs can be reduced. Furthermore, the claws embedded in the heat pipe 2 make a thickness of the whole heat sink is equal to that of the heat pipe 2. That is to say, the heat sink is effectively thinned.

Additionally, a width of the receiving space 12 can be adjusted by arranging the location of the two elastic plates 11. This can match various heat pipes with different widths for enhancing availability of the invention.

In an initial step of a method for manufacturing the heat sink of the invention, a fastener 1 is provided, wherein the fastener 1 is formed with a receiving space 12, upper claws 13 and lower claws 14, the fastener 1 is formed with two parallel longitudinal sections 111, the receiving space 12 is formed between the longitudinal sections 111.

In a second step of the manufacturing method, a heat pipe 2 is provided, wherein the heat pipe 2 is received in the receiving space 12 and clipped between the upper claws 13 and the lower claws 14. The thickness of the heat pipe 2 is less than 3 mm.

In a third step of the manufacturing method, a press machine 100 is provided to embed the upper claws 13 and the lower claws 14 into the heat pipe 2. The heat pipe 2 is deformed to form the recesses 23. The upper claws 13 and the lower claws 14 are flush with the heat pipe 2.

The interlaced claws 13, 14 can prevent the thickness of the heat pipe 2 is too thin. Thus the invention has a great performance of heat transfer.

Figure 6:
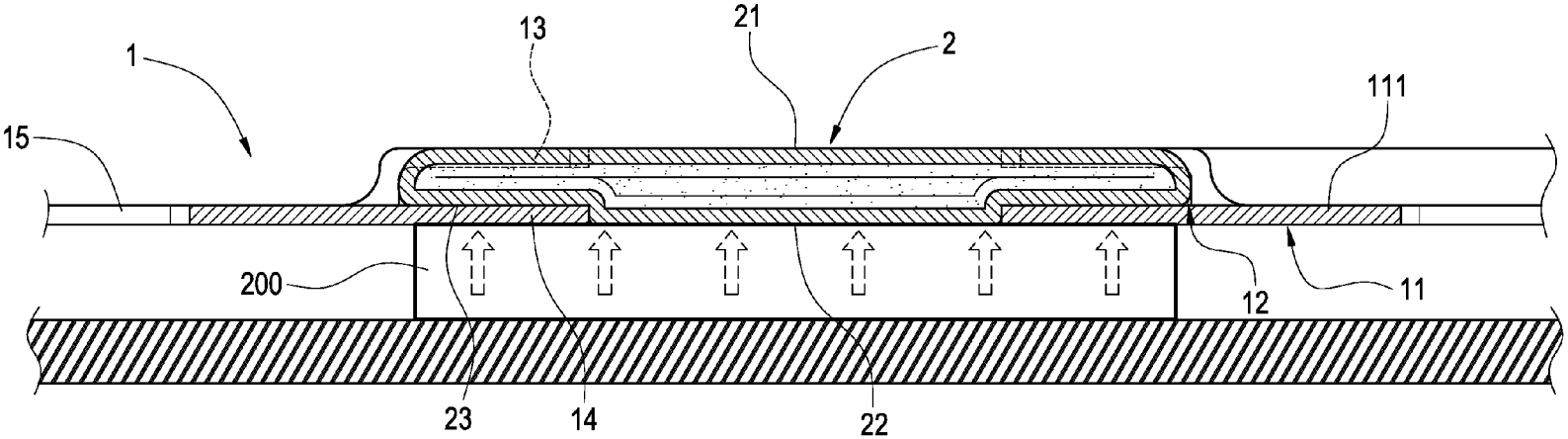
FIG. 6 is a schematic view showing the invention in a using status.

Please refer to FIG. 6. Because of the coplanarity of the lower claws 14 and the second plane 22, the coplanar surface planarly abuts against a heat-generating device 200. As a result, the heat can be transferred to the fins 3 through the heat pipe 2. The invention does not need a soldering process, so the efficiency of heat dissipation can be enhanced.

Figure 7:
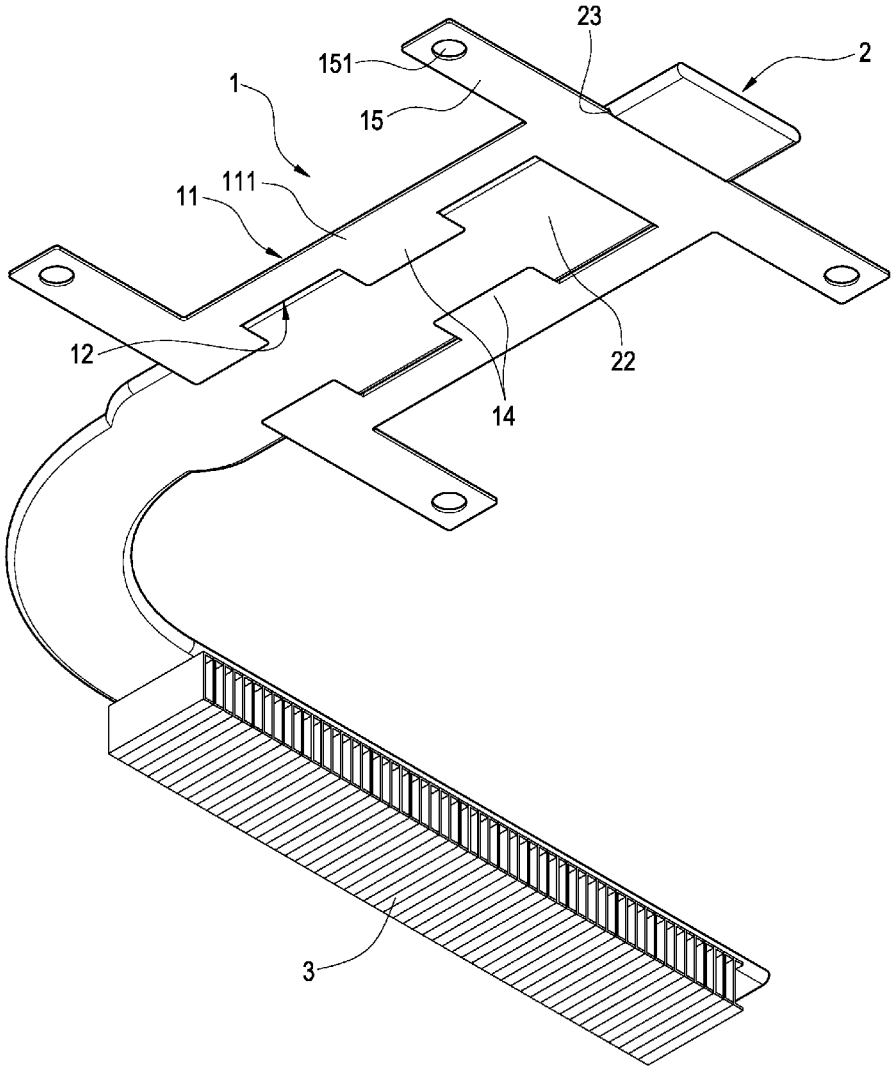
FIG. 7 shows another embodiment of the invention.

Please refer to FIG. 7, which shows another embodiment of the invention. In this embodiment, the fastener 1 is a single piece with two longitudinal sections 111. The strength of the fastener 1 can be enhanced because an additional connection is arranged between the two elastic plates 11.

It will be appreciated by persons skilled in the art that the above embodiments have been described by way of example only and not in any limitative sense, and that various alterations and modifications are possible without departure from the scope of the invention as defined by the appended claims.

What is claimed is:

1. A heat sink comprising:

a fastener including two elastic plates, an upper claw and a lower claw formed on each of the two elastic plates and extending therefrom, wherein a receiving space is defined by the two elastic plates, the two upper claws and the two lower claws, wherein the two claws are coplanarly formed on the two elastic plates respectively, the two lower claws are coplanarly formed on the two elastic plates respectively, the two upper claws and the two lower claws are formed in different planes, and the two upper claws are parallel to the two lower claws; and a heat pipe, having a first end and a second end, wherein the first end is received in the receiving space and clipped between the two upper claws and the two lower claws, and the two upper claws or the two lower claws are embedded in the heat pipe, wherein the fastener is formed with two longitudinal sections, the receiving space is formed between the longitudinal sections, the two upper claws interlace with the two lower claws, and the two upper claws are bendingly extended from the two elastic plates.

2. The heat sink of claim 1, wherein the heat pipe is deformed by the two upper claws and the two lower claws to form recesses.

3. The heat sink of claim 1, wherein the two elastic plates connect to each other, the two elastic plates separately form two longitudinal sections, and the receiving space is formed between the longitudinal sections.

4. The heat sink of claim 1, wherein the two elastic plates are separated, the two separated elastic plates separately form two longitudinal sections, and the receiving space is formed between the longitudinal sections.

5. The heat sink of claim 1, wherein the fastener is formed with two longitudinal sections, the receiving space is formed between the longitudinal sections, the fastener is formed with at least one outwards fixture with a fixing hole.

6. The heat sink of claim 1, wherein the second end of the heat pipe is disposed with fins.

* * * * *